US006189361B1

(12) United States Patent
Seki et al.

(10) Patent No.: US 6,189,361 B1
(45) Date of Patent: Feb. 20, 2001

(54) TOOL FOR FORMING PROTRUSIONS IN MATERIAL BY CUTTING AND DEFORMING

(75) Inventors: Masayuki Seki; Masami Iwamoto, both of Kanagawa (JP)

(73) Assignee: Amada Metrecs Company Limited, Kanagawa (JP)

( * ) Notice: Under 35 U.S.C. 154(b), the term of this patent shall be extended for 0 days.

(21) Appl. No.: 09/486,872

(22) PCT Filed: Sep. 2, 1998

(86) PCT No.: PCT/JP98/03925

§ 371 Date: Mar. 3, 2000

§ 102(e) Date: Mar. 3, 2000

(87) PCT Pub. No.: WO99/11399

PCT Pub. Date: Mar. 11, 1999

(30) Foreign Application Priority Data

Sep. 4, 1997 (JP) ..... 9-240046
Sep. 4, 1997 (JP) ..... 9-240048

(51) Int. Cl.[7] ..... B21D 28/00
(52) U.S. Cl. ..... 72/325; 72/395; 72/452.9
(58) Field of Search ..... 72/324–326, 464, 72/395, 394, 383, 452.9

(56) References Cited

U.S. PATENT DOCUMENTS 3,713,574 * 1/1973 Lewis ..... 72/452.9
3,862,561 * 1/1975 Uebayashi ..... 72/325
3,971,244 * 7/1976 Zengerer ..... 72/395
4,557,029 * 12/1985 Stewart ..... 72/325
5,927,136 * 7/1999 Reynolds ..... 72/325

FOREIGN PATENT DOCUMENTS

09085358 * 6/1922 (JP) ..... 72/325
160816 * 6/1922 (GB) ..... 72/395
09122777 * 5/1997 (JP) ..... 72/325

* cited by examiner

*Primary Examiner*—Daniel C. Crane
(74) *Attorney, Agent, or Firm*—Blank Rome Comisky & McCauley, LLP

(57) ABSTRACT

There provides a tool, which is capable of smoothly executing a cutting and protruding process in all the steps from the starting to ending of cutting and protruding of a small protrusion when the protrusion is cut and protruded on an upper surface of a workpiece. In a protrusion forming tool for forming a protrusion 33 on a surface of a workpiece by cooperation of a punch 3 and a die 7, the punch 3 has a cylindrical punch guide 9, and a punch driver 15 having a punch head 17 at its upper end is provided to an upper portion of the punch guide 9 so as to be movable up and down and so that a force is applied to the punch driver 15, and an elastic member 23 is provided between an up/down slider 21, which is provided in a position below the punch driver 15 in the punch guide 9 movably up and down, and the punch driver 15, and a cutting and protruding blade 25C for cutting and protruding a protrusion on a surface of a workpiece is provided at a lower end of a punch body 25 which is provided in a position below the up/down slider 21 in the punch guide 9, and an upper surface of the punch body 25 is brought into surface-contact with an inclined surface 21A on a lower surface of the up/down slider 21.

9 Claims, 9 Drawing Sheets

TOOL FOR FORMING PROTRUSIONS IN MATERIAL BY CUTTING AND DEFORMING

This application is a 371 of PCT/JP98/03925, filed Sep. 2, 1998.

TECHNICAL FIELD

The present invention relates to a protrusion forming tool device which is mounted to a punch press such as a turret punch press so as to be used, and more specifically relates to a protrusion forming tool for cutting and protruding one portion of a surface of a plate workpiece by means of scratching process so as to form a small protrusion.

BACKGROUND ART

A prior example relating to the present invention is disclosed in Japanese Patent Application Laid-Open No. 9-85358, for example. As shown in FIG. 10, in this prior example, a punch driver 205 having a punch head 203 on its upper end is provided to a cylindrical punch guide 201 so as to be movable up and down. A substantially semicircular or substantially triangular blade member 207 having a cutting and protruding blade at its forward end is supported into the punch guide 201 in a position below the punch driver 205 via a pin 209 so as to revolve in a horizontal direction. Moreover, a force is applied to the blade member 207 by a force applying means 211 mounted into the punch guide 201 in a direction where the blade member 207 separates from an upper surface of a workpiece W.

In the above structure, a striker 213 which is provided to the punch press movably up and down strikes the punch head 203 and lowers the punch driver 205 against a stripper spring 215. When a protruded portion 217 provided to a lower end of the punch driver 205 pushes the blade member 207 to a downward direction, the blade member 207 revolves about the pin 209 to the horizontal direction, and the cutting and protruding blade at the forward end of the blade member 207 cuts into the upper surface of the workpiece W supported to a die 219. As a result, the upper surface of the workpiece W is scratched so that a small protrusion 221 is cut and protruded.

In the structure of the prior example, a force is applied to the blade member 207 by the force applying means 211 to the direction where the blade member 207 separates from the workpiece W, and the blade member 207 is mounted into the punch guide 201 via the pin 209 so as to revolve in the horizontal direction. For this reason, it is troublesome to work a pin hole into the punch guide 201 and to assemble the blade member 207 and the like into the punch guide 201. Namely, there arises a problem that the working and assembly of the blade member 207 are troublesome.

In addition, since the protruded portion 217 which is provided to the lower end of the punch driver 205 pushes the blade member 207 directly to the downward direction, a height of a position where the punch head 203 is mounted to the punch driver 205 should be adjusted accurately so that the insufficient revolving of blade member 207 due to the cutting and protruding of the protrusion 221 does not occur. Namely, it is troublesome to adjust the mounting position of the punch head 203.

Furthermore, since the blade member 207 is revolved about the pin 209 in the horizontal direction by the protruded portion 217 at the lower end of the punch driver 205 which moves up and down, a contact portion between the protruded portion 217 and the blade member 207 is gradually inclined, and a component of force for revolving the blade member 207 in the horizontal direction becomes weak gradually. As a result, there arises a problem when the protrusion 221 is cut and protruded and the forming accuracy of the protrusion 221 is improved.

DISCLOSURE OF THE INVENTION

The present invention has been achieved in order to solve the above conventional problems. According to a first claim of the invention, a protrusion forming tool for cutting and protruding a portion of a surface of a workpiece so as to form a protrusion by means of cooperation of a punch and a die, wherein the punch includes: a cylindrical punch guide which is supported to a punch holder in a punch press movably up and down; a punch driver provided to an upper portion of the punch guide, wherein the punch driver having a punch head at its upper end is movable up and down and is pushed upwardly; an up/down slider, wherein an inclined surface is provided on a lower surface of the up/down slider and wherein the up/down slider is provided in a position below the punch driver in the punch guide movably up and down; an elastic member, wherein the elastic member is provided between the up/down slider and the punch driver; a workpiece retainer, wherein the workpiece retainer is provided at a lower portion of the punch guide; and a punch body, wherein the punch body is provided in a position below the up/down slider in the punch guide so as to be movable up and down and movable in a radial direction of the punch guide and wherein a lower portion of the punch body can be protruded to a downward direction from the workpiece retainer, wherein the punch body is provided with a cutting and protruding blade at a lower end of the punch body for cutting and protruding the protrusion on the surface of the workpiece; and wherein the punch body is provided with an inclined surface on an upper surface of the punch body, and the inclined surface comes into surface-contact with the inclined surface formed on the lower surface of the up/down slider.

According to a second claim of the invention, in the invention depending from the first claim, the workpiece retainer has a guiding hole for guiding the punch body in the radial direction, and the workpiece retainer has a sliding-contact surface which slides and contacts with a sliding-contact surface formed on the lower portion of the punch body so as to limit a protruding amount of the punch body to the downward direction.

According to a third claim of the invention, in the invention depending from the first or second claim, the lower surface of the up/down slider is provided with a plurality of inclined surfaces having different inclined directions, wherein the inclined surfaces slide-contact respectively with other inclined surfaces which are provided on a plurality of upper surfaces of a plurality of punch bodies so that the plurality of punch bodies come close to and separate from each other.

According to a fourth claim of the invention, in the invention depending from the first, second or third claim, a punch tip which has the cutting and protruding blade is provided at a lower portion of the punch body detachably and changeably.

According to a fifth claim of the invention, in the invention depending from the fourth claim, the punch tip has a polygon shape such that cutting and protruding blades are provided on plural portions of the punch tip.

According to a sixth claim of the invention, in the invention depending from the first claim, the die is provided with a protecting member on an upper surface of the die, wherein the material of the protecting member is softer than a material of the die.

BEST MODE FOR CARRYING OUT THE INVENTION

Figure 1A:
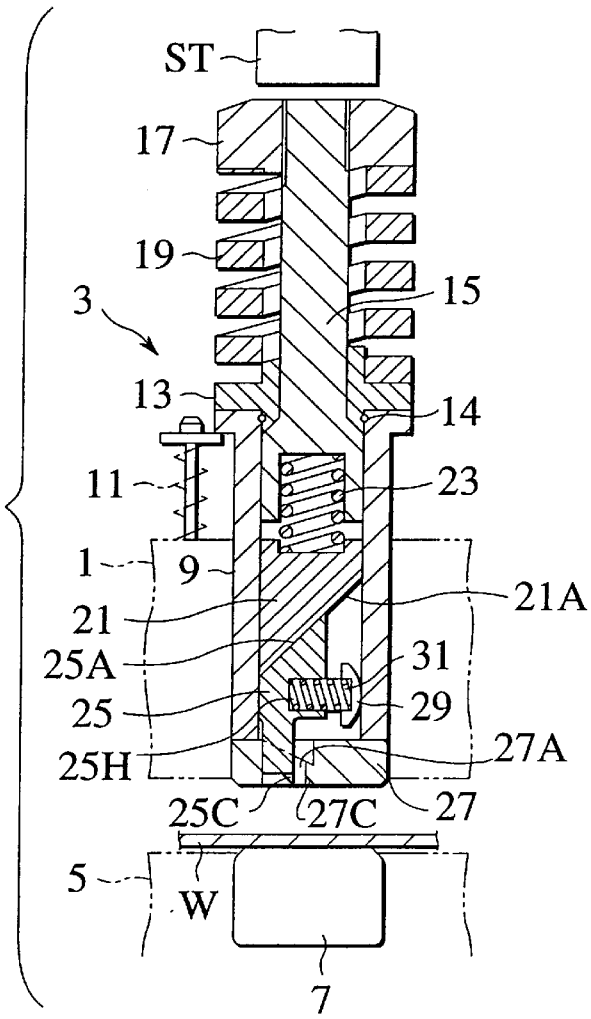
FIGS. 1A, 1B are explanatory cross sections of a punch according to a first embodiment of the present invention.
Figure 1B:
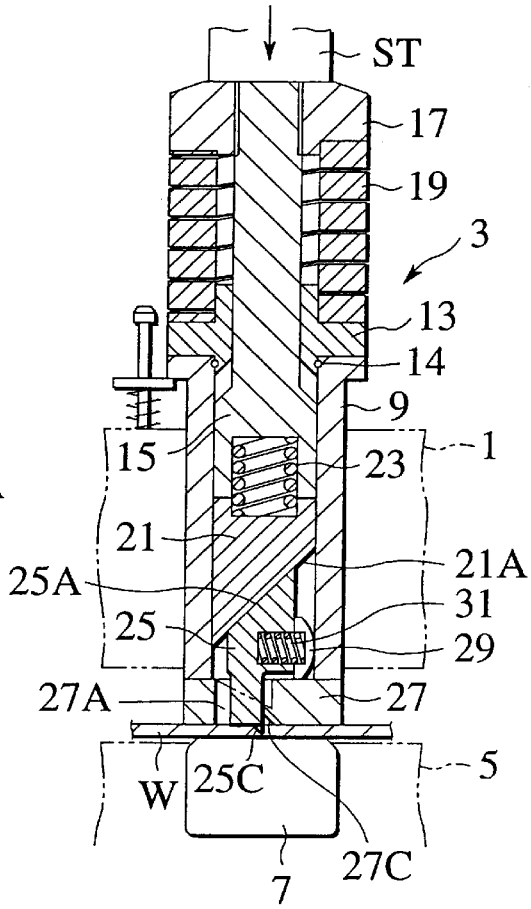

With reference to FIG. 1, a protrusion forming tool of the present embodiment has a punch 3 which is supported to a punch holder 1 (corresponding to an upper turret in the case of the turret punch press) in a punch press (not shown) such as a turret punch press, and a die 7 which is supported to a die holder 5 (lower turret) in the punch press.

The punch 3 has a cylindrical punch guide 9 which is supported to the punch holder 1 movably up and down. The punch guide 9 is supported in a position of predetermined height by a well-known lifter spring 11 provided to plural portions of the punch holder 1 so as to be movable up and down.

A ring-shaped retainer collar 13 is mounted to an upper portion of the punch guide 9 via a O ring 14 detachably, and a punch head 17 is fitted into and fixed to an upper end of a punch driver 15, through which the retainer collar 13 pierces movably up and down and whose lower side is fitted into the punch guide 9 movably up and down, so that its height position can be adjusted. Moreover, a powerful stripper spring (elastic member) 19 is elastically mounted between the retainer collar 13 and the punch head 17. A force is always applied to the punch driver 15 by the stripper spring 19 in an upward direction.

An up/down slider 21 whose lower surface is formed into an inclined surface 21A is fitted into a position below the punch driver 15 in the punch guide 9 so as to be movable up and down. A suitable elastic member 23 which is composed of, for example, a coil spring, a belleville spring and urethane rubber is provided between an upper surface of the up/down slider 21 and a lower surface of the punch driver 15.

A punch body 25 is mounted to a position below the up/down slider 21 in the punch guide 9 so as to be movable up and down and movable in a radial direction of the punch guide 9. A disc-shaped workpiece retainer 27 which restrains the movement of the punch body 25 in the downward direction is mounted to the lower end of the punch guide 9 by a plurality of bolts (not shown) detachably.

Figure 2:
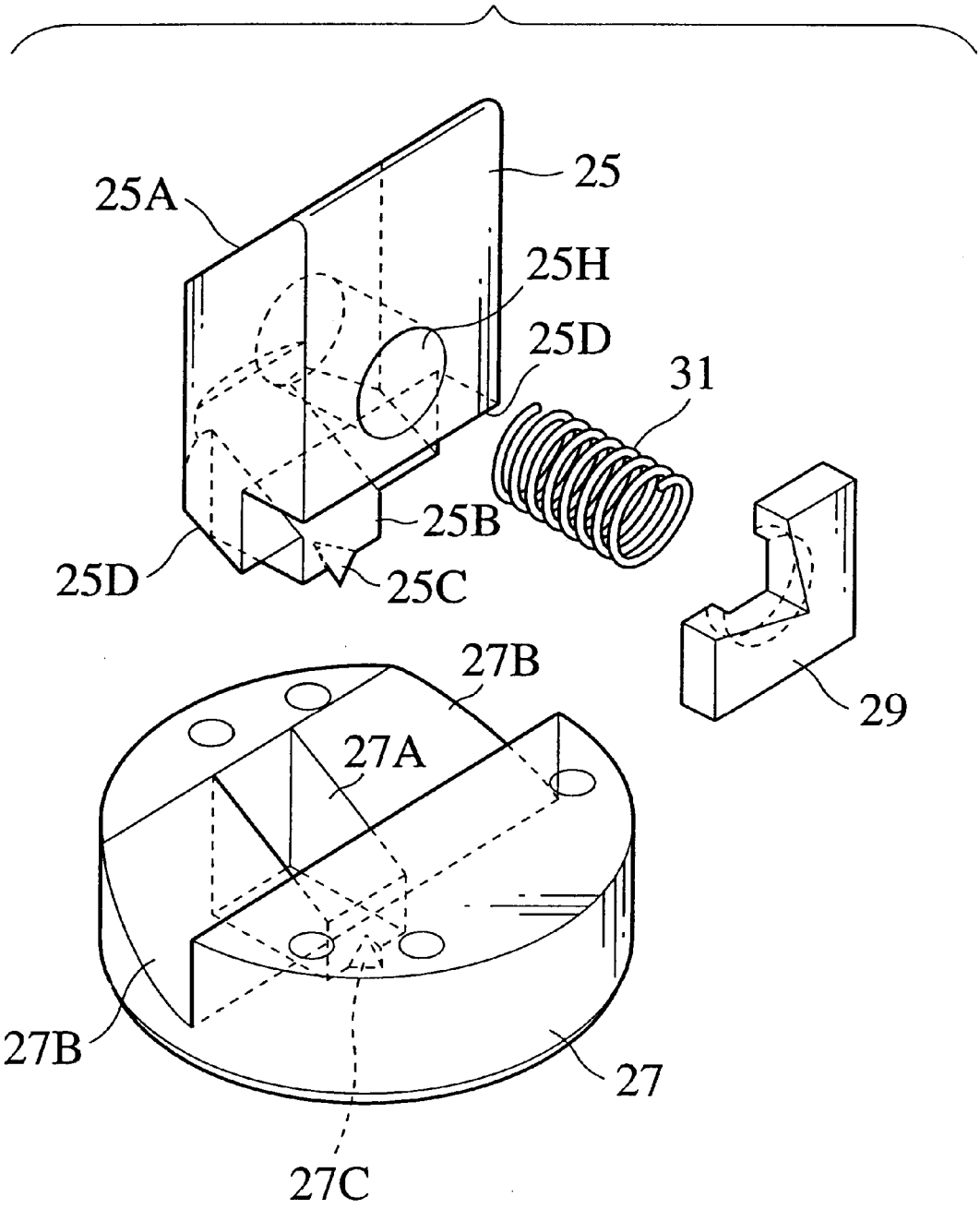
FIG. 2 is an explanatory perspective view showing details of a punch body a workpiece retainer.

As shown in detail in FIG. 2, the upper surface of the punch body 25 is formed into an inclined surface 25A which comes in surface-contact with the inclined surface 21A of the up/down slider 21. Moreover, a lower protruded portion 25B, which is guided by a guiding hole 27A of the radial direction formed at a center portion of the workpiece retainer 27 and is movable to the radial direction and pierces through the guiding hole 27A so as to be protruded to the downward direction, is provided to a center of the lower surface of the punch body 25. A triangular cutting and protruding blade 25C for cutting and protruding a protrusion on the upper surface of the plate workpiece W supported onto the die 7 by means of the scratching action is protruded from and provided to a lower surface of the lower protruded portion 25B.

Further, a lower surface 25D of the lower protruded portion 25B in a side position in the punch body 25 is formed into an inclined surface which comes in surface-contact slidably with an inclined surface 27B formed on both sides of the guiding hole 27A in the workpiece retainer 27. A triangular concave portion 27C which houses the protrusion cut and protruded by the cutting and protruding blade 25C is formed in a position of the lower surface of the workpiece retainer 27 which faces the cutting and protruding blade 25C.

In order to maintain the inclined surface 21A of the up/down slider 21 and the inclined surface 25A of the punch body 25 in a state that they always come in surface-contact with each other, an elastic member 31 such as a coil spring, which pushes and applies a force to the punch body 25 against and to the upper side of the inclined surface 27B in the workpiece retainer 27 on one side of the radial direction, is elastically mounted between a slide spring washer 29, which is provided on an inner surface of the punch guide 9 movably up and down, and a hole 25H provided in the punch body 25.

Incidentally, the inclined direction of the inclined surface 21A of the up/down slider 21 is opposite to the inclined direction of the inclined surface 27B formed on the workpiece retainer 27, and as for the inclination on the horizontal basis, the inclined surface 21A of the up/down slider 21 is more steep.

In the above structure, when the punch head 17 is struck and is lowered by a striker ST provided in the punch press movably up and down in the state that the plate workpiece W is located on the die 7, the whole punch 3 is lowered against the lifter spring 11, and the workpiece retainer 27 provided to the lower end of the punch guide 9 comes in contact with the upper surface of the workpiece W. When the workpiece W is pushed against the die 7, the lowering of the punch guide 9 is stopped.

Thereafter, when the punch head 17 is further lowered against the stripper spring 19, the up/down slider 21 is lowered via the elastic member 23. As a result, due to the surface-contact between the inclined surface 21A of the up/down slider 21 and the inclined surface 25A of the punch body 25, the punch body 25 is moved to the downward direction, and the punch body 25 is moved to an inner side of the radial direction of the punch guide 9 against the applied force of the elastic member 31 by a component of force which is applied to the radial direction.

At this time, since the lower surface 25D of the punch body 25 surface-contacts with the inclined surface 27B of the workpiece retainer 27, the punch body 25 is gradually lowered along the inclined surface 27B. Then, when the triangular cutting and protruding blade 25C, which is formed on the lower surface of the lower protruded portion 25B in the punch body 25, is protruded from the lower surface of the workpiece retainer 27 to the downward direction, the cutting and protruding blade 25C gradually moves to the inner side of the radial direction while it is cutting into the upper surface of the workpiece W.

Figure 3A:
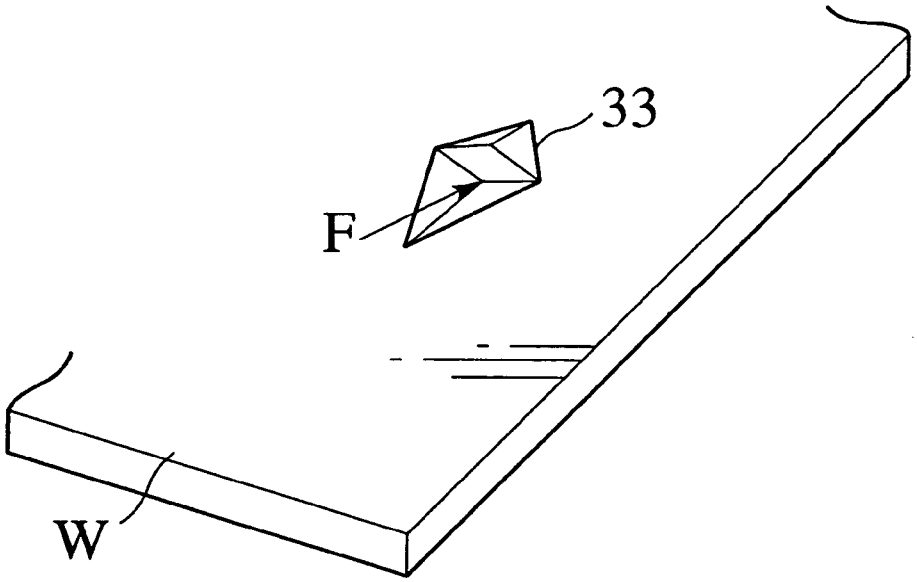
FIGS. 3A and 3B are explanatory diagrams showing a forming example of a protrusion on an upper surface of the workpiece.
Figure 3B:
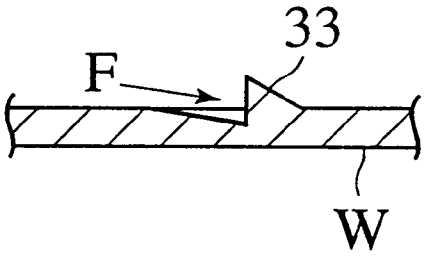

Namely, as shown by an arrow F of FIG. 3, the cutting and protruding blade 25C cuts into the upper surface of the workpiece W in a diagonally downward direction and is scratched so as to cut and protrude a protrusion 33. When the protrusion 33 is gradually cut and protruded by the cutting and protruding blade 25C, the protrusion 33 is gradually housed in the triangular concave portion 27C formed on the lower surface of the workpiece 27 and is finally pushed against the concave portion 27C. As a result, the protrusion 33 is formed into the accurately triangular form.

As understood from the above structure, in the present embodiment, since the elastic member 23 is provided between the punch driver 15 and the up/down slider 21, even in the case where the mounting position of the punch head 17 with respect to the punch driver 15 is not accurate, namely, is too high, this problem is solved by contracting of the elastic member 23.

In addition, when according to the lowering of the striker ST, the punch driver 15 is lowered gradually and the cutting and protruding blade 25C provided to the punch body 25 cuts into the upper surface of the workpiece W, the elastic member 23 is compressed gradually and restitution becomes stronger gradually. As a result, the component of force of the horizontal direction which acts between the inclined surface 21A of the up/down slider 21 and the inclined surface 25A of the punch body 25 becomes stronger gradually. Therefore, as a cutting depth of the cutting and protruding blade 25C into the upper surface of the workpiece W becomes larger, the component of force in the horizontal direction becomes stronger. As a result, even if the cutting and protruding resistance of the protrusion 33 tends to become stronger gradually, the protrusion 33 can be cut and protruded smoothly.

As mentioned above, when the striker ST is raised after the protrusion 33 is formed on the upper surface of the workpiece W, the punch driver 15 is raised to be returned to its original position by the action of the stripper spring 19, and the punch body 25 and the up/down slider 21 are returned to their original positions by the action of the elastic member 31, and the whole punch 3 is raised to be returned to its original position by the action of the lifter spring 11.

Figure 4:
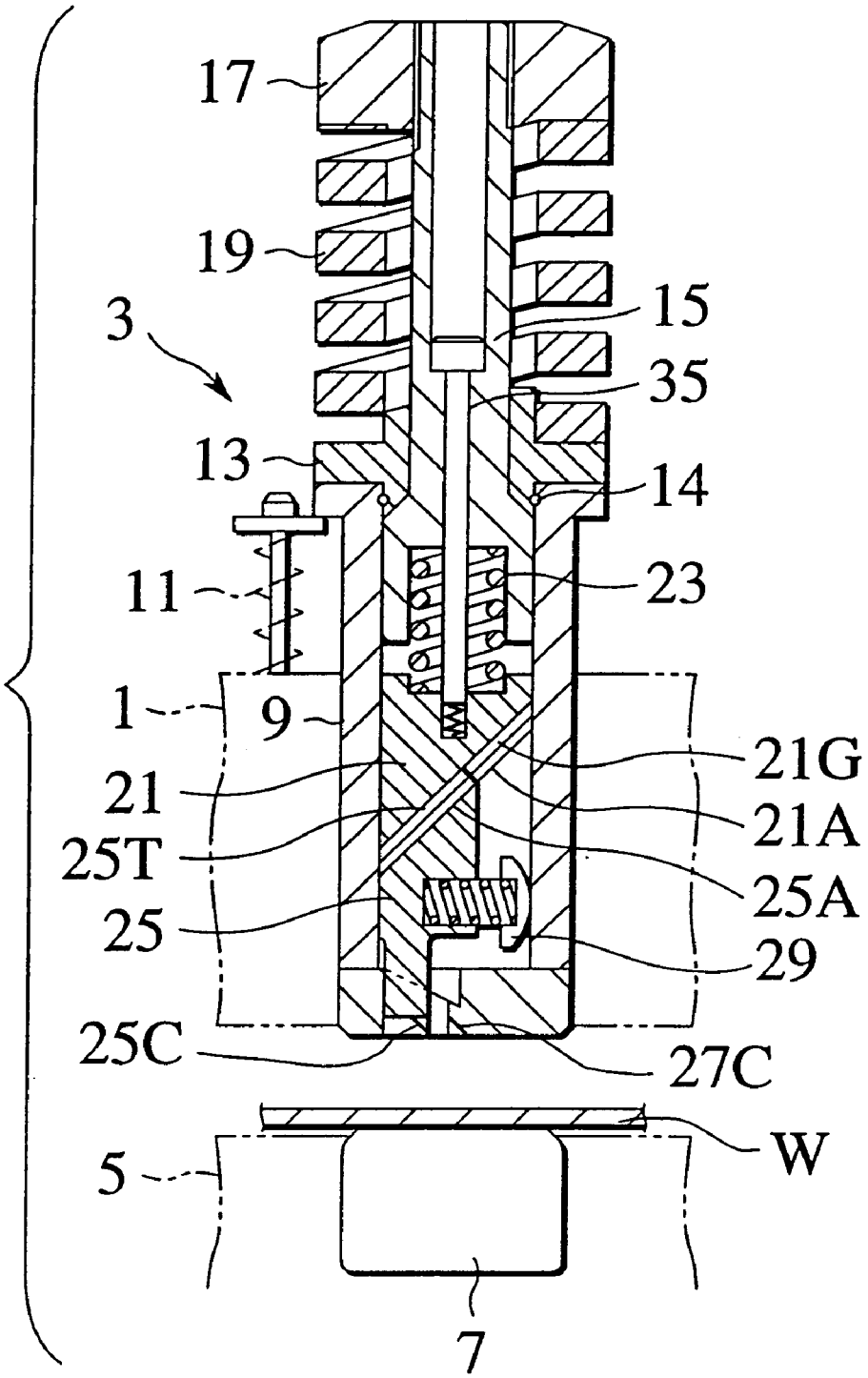
FIG. 4 is an explanatory cross section of the punch according to a second embodiment.

FIG. 4 shows a second embodiment. In the second embodiment, the lower end of a connecting member 35 such as a bolt which pierces through the punch driver 15 movably up and down is fitted into and connected to the up/down slider 21. A T-shaped or dovetail-shaped slide protrusion 25T, which is formed on the inclined surface 25A of the punch body 25, is engaged with a T-shaped or dovetail-shaped guiding groove 21G, which is formed on the inclined surface 21A of the up/down slider 21, so as to slide freely. The other parts of the structure are the same as those of the structure in the embodiment 1.

Here, it is relative that the connecting member 35 is connected to the up/down slider 21 or the up/down slider 21 pierces through to be connected to the punch driver 15 movably up and down. Moreover, it is relative that the guiding groove 21G is provided on the inclined surface 21A of the up/down slider 21 and the slide protrusion 25T is provided to the punch body 25, or on the contrary that the guiding groove is formed on the punch body 25 side and the slide projection which is engaged with the guiding groove so as to slide freely is provided to the up/down slider 21 side.

In the second embodiment, the punch driver 15 is connected to the up/down slider 21 via the connecting member 35 so that their separation in the vertical direction is limited. Moreover, according to the engagement of the guiding groove 21G with the slide protrusion 25T, the up/down slider 21 is mechanically engaged and connected with the punch body 25. As a result, the connected portions can be treated as a unit, and the assembly can be executed easily.

In addition, according to the above structure, the up/down slider 21 can be lifted via the connecting member 35, and since the guiding groove 21G is mechanically engaged with the slide protrusion 25 so as to slide freely, the punch body 25 can be lifted simultaneously with the up/down slider 21. As a result, the punch body 25 can be lifted by utilizing the restitution of the stripper spring 19, and the cutting and protruding blade 25 can be securely separated from the workpiece W into which the cutting and protruding blade 25 cuts.

Figure 5A:
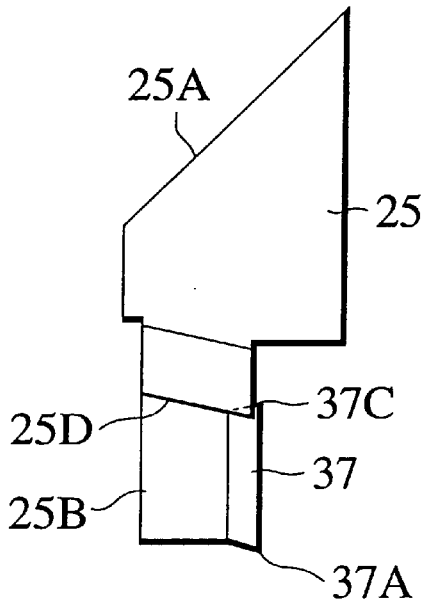
FIGS. 5A and 5B are explanatory diagrams showing mounting of a punch tip to the punch body.
Figure 5B:
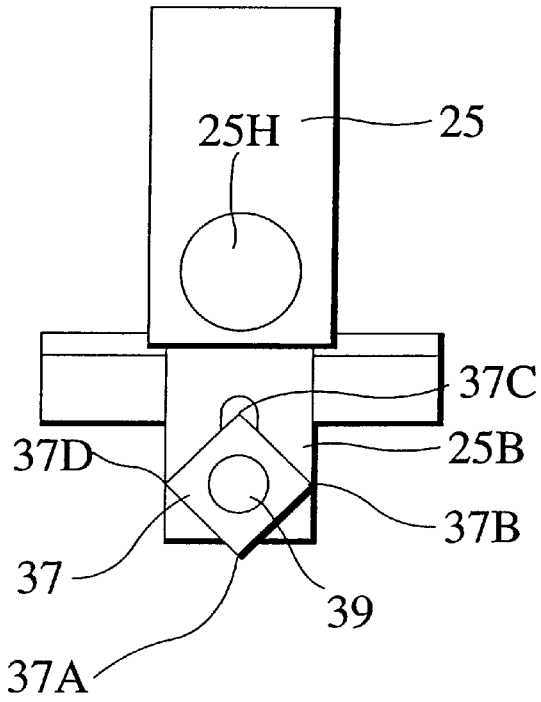

FIG. 5 shows a modified example of the punch body 25, and this punch body is greatly different from in that a polygon punch tip 37, which has cutting and protruding blades 37A, 37B, 37C and 37D at its plural portions, is provided detachably to the punch body 25 via a fixing tool 39 such as a bolt.

In this structure, when the one cutting and protruding blade 37A of the punch tip 37 is worn out, it can be replaced by the adjacent cutting and protruding blade 37B, and when all the cutting and protruding blades 37A through 37D are worn out, the punch tip 37 can be replaced by new one.

Figure 6A:
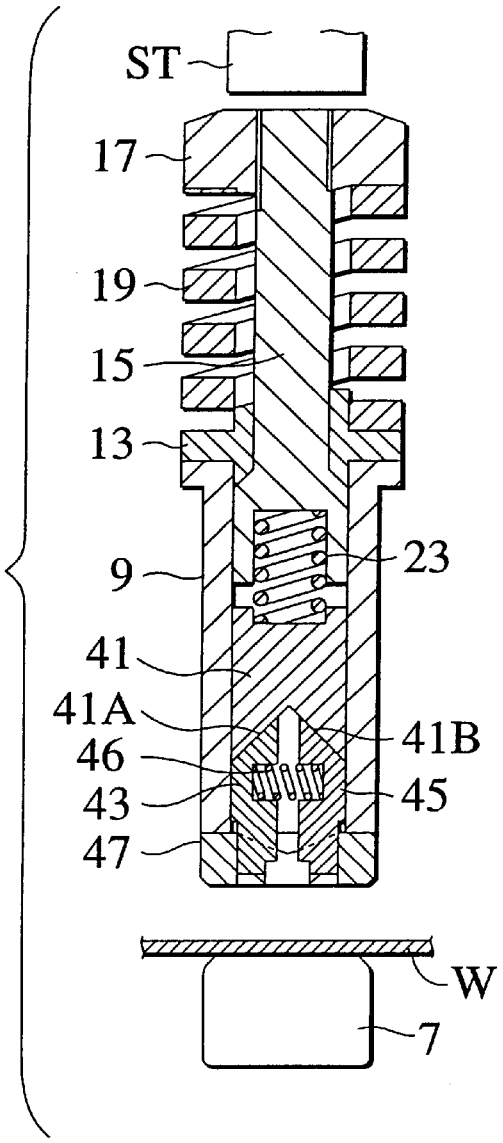
FIGS. 6A and 6B are explanatory cross sections of the punch according to the third embodiment.
Figure 6B:
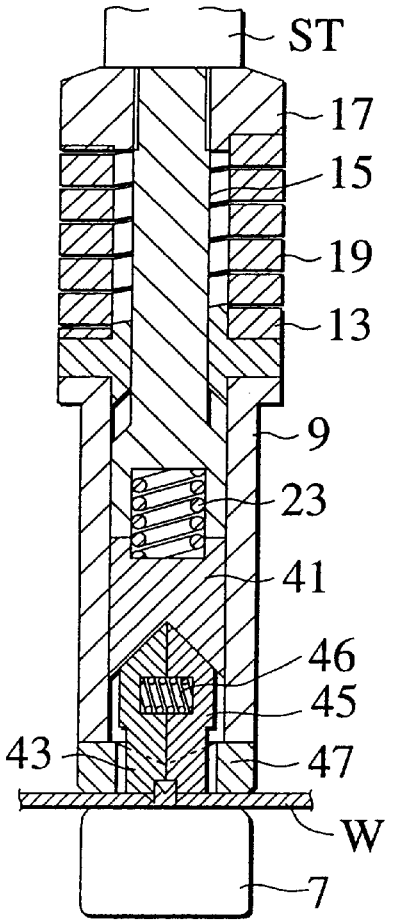

FIG. 6 shows a third embodiment of the punch 3, and it is different from the punch in the embodiments 1 and 2 in that inclined surfaces 41A and 41B, which are inclined so that the part from the center to outer side is lower, are provided to the lower surface of an up/down slider 41 so as to face each other symmetrically, and a first punch body 43 which has the same shape as that of the punch body 25 and a second punch body 45 which has the symmetric shape with the shape of the first punch body 43 are positioned so as to face each other, and an elastic member 46 such as a coil spring which acts so as to separate both the punch bodies 43 and 45 is elastically provided between the first and second punch bodies 43 and 45.

Figure 7:
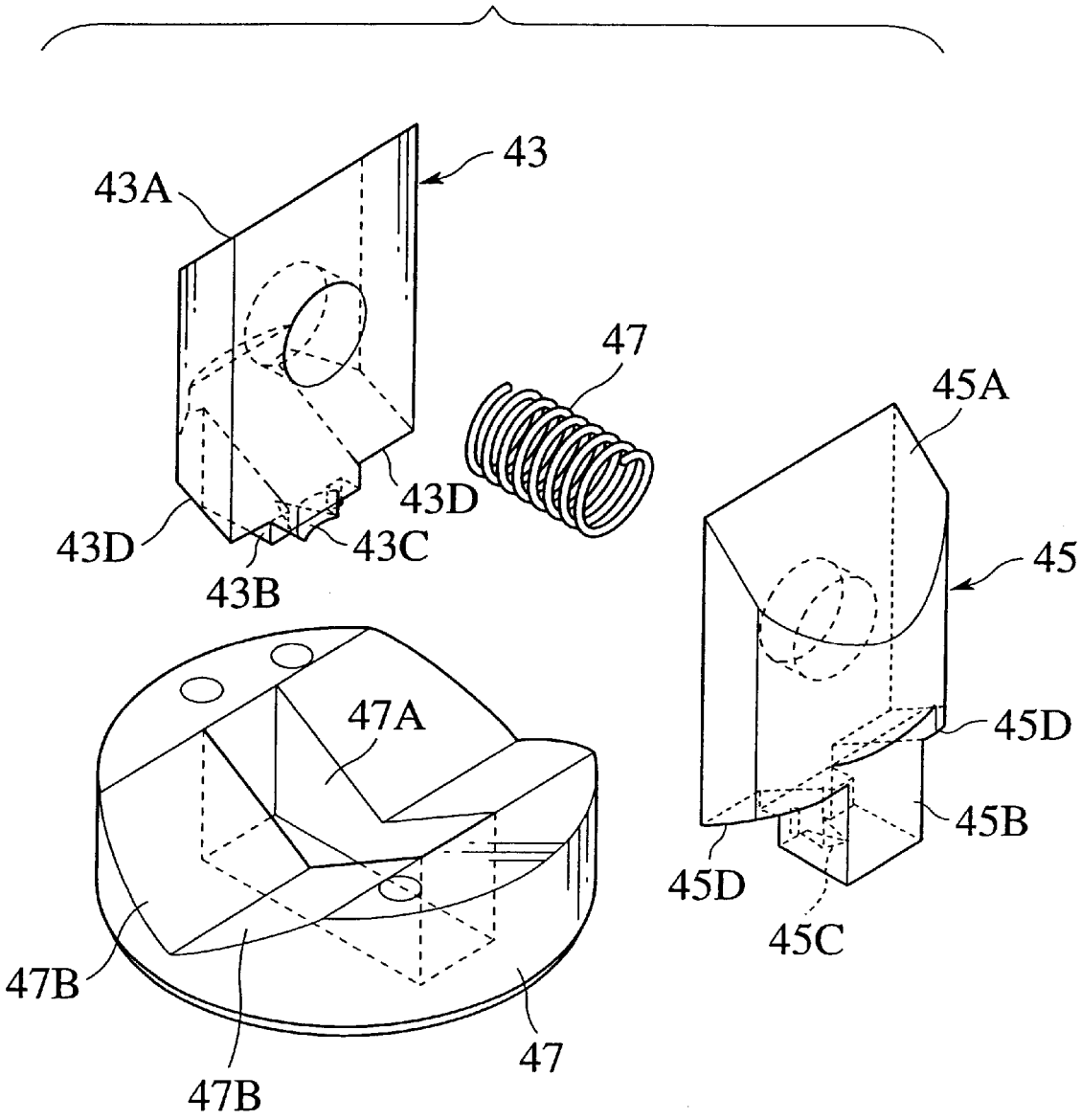
FIG. 7 is an explanatory perspective view showing details of the punch body and the workpiece retainer according to the third embodiment.

As shown in FIG. 7, the punch bodies 43 and 45 respectively have inclined surfaces 43A and 45A, downward protruded portions 43B and 45B, cutting and protruding blades 43C and 45C and inclined lower surfaces 43D and 45D which correspond to the inclined surface 25A, the downward protruded portion 25B, the cutting and protruding blade 25C and the inclined lower surface 25D in the punch body 25.

Moreover, a workpiece retainer 47 corresponding to the workpiece retainer 27 has a guiding hole 47A for guiding the first and second punch bodies 43 and 45 in the radial direction, and V-shaped inclined surfaces 47B corresponding to the inclined surface 27B. The workpiece retainer 47 is rather different from the workpiece retainer 27 in that a concave portion corresponding to the concave portion 27C is not provided.

However, since the other parts of the structure are the same as the structure in the embodiment 1 and their functions are identical to each other, the same reference numerals are given to the components having the same functions and the detailed description thereof is omitted.

Figure 8:
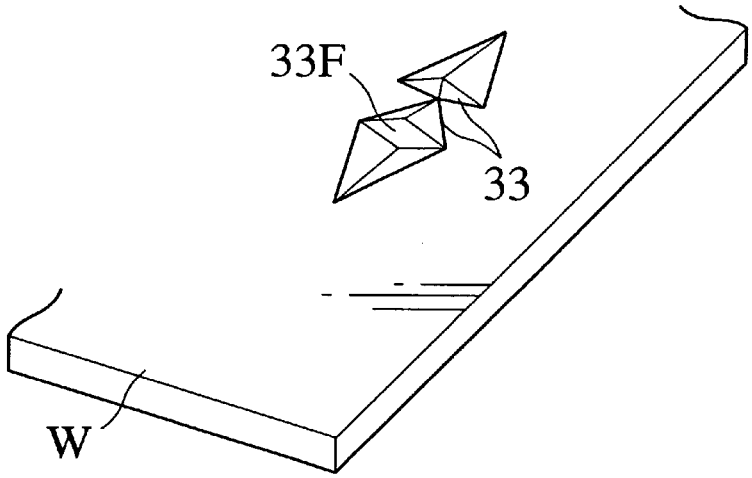
FIG. 8 is an explanatory diagram showing the case where a plurality of protrusions are formed on the upper surface of the workpiece.

In the third embodiment, when the punch head 17 is struck and lowered by the striker ST, the first and second punch bodies 43 and 45 move so as to come close to each other, and protrusions 33 are cut and protruded by the cutting and protruding blades 43C and 45C provided at their lower end. As a result, as shown in FIG. 8, both the protrusions 33 which are cut and protruded by the cutting and protruding blades 43C and 45C are formed adjacently and symmetrically.

In this case, since an interval of vertical surfaces 33F of both the protrusions 33 on the opposite side is always uniform, when the vertical surfaces 33F are used as locating surfaces, the protrusions 33 are inserted through a slot or square hole blanked in a member to be located, for example, so that the member to be located can be located accurately.

Figure 9:
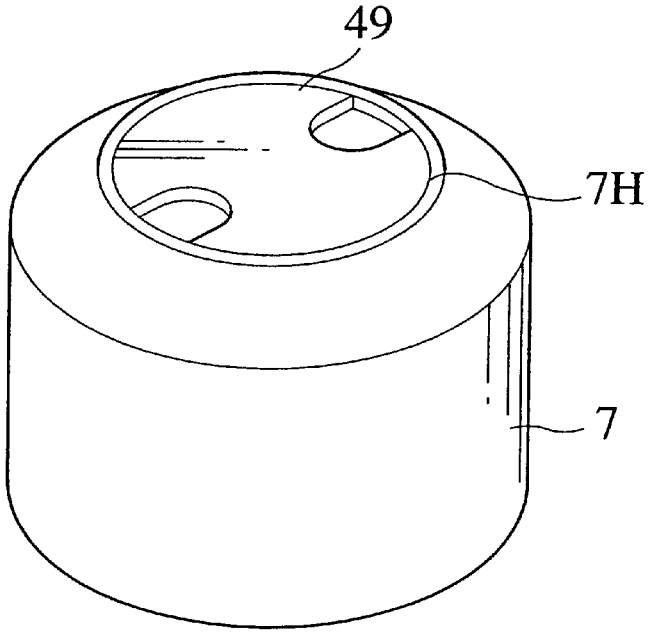
FIG. 9 is an explanatory perspective view showing a structure of a die.
Figure 10A:
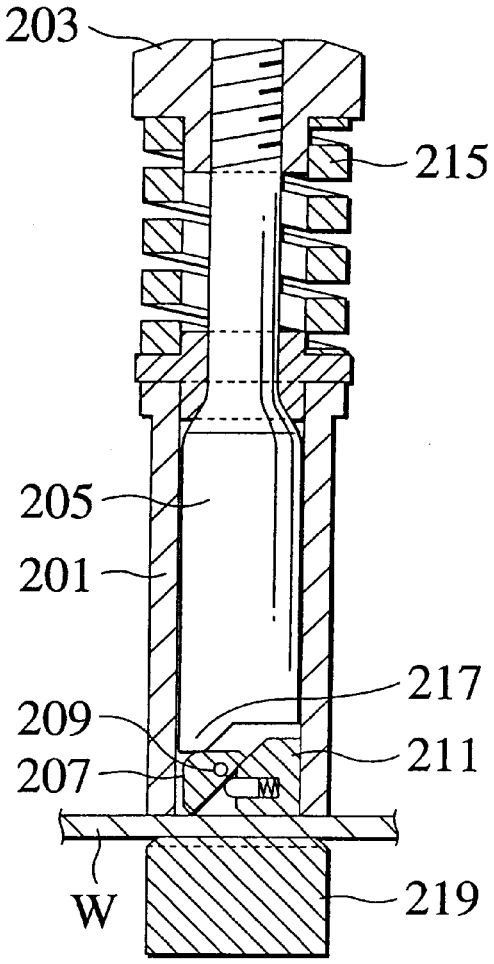
FIGS. 10A and 10B are explanatory cross sections of the punch according to the prior example.
Figure 10B:
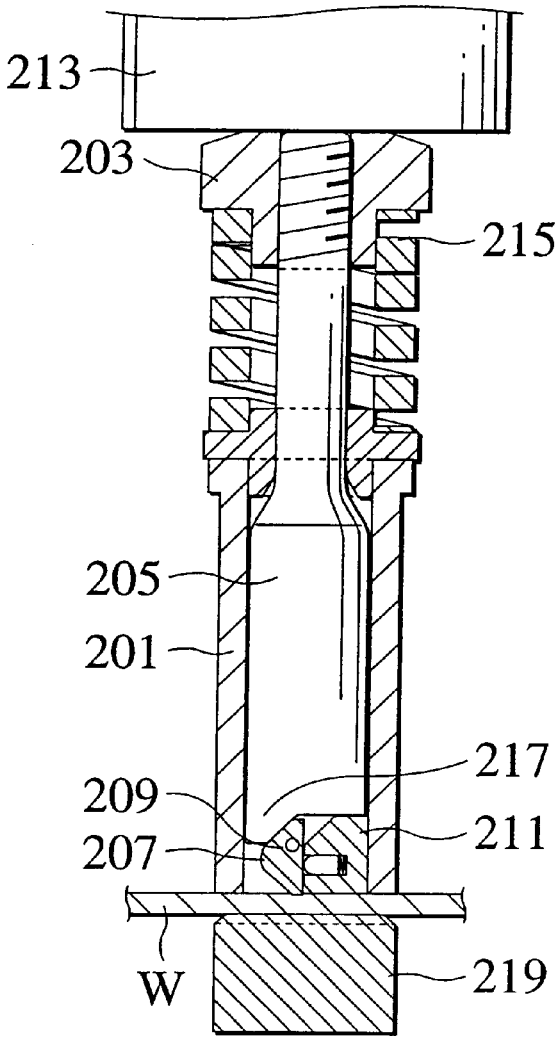

FIG. 9 shows the die 7 which faces the punch 3. A disc-shaped protecting member 49, made of resin, such as plastic, or non-iron metal which is softer than a material of the die, is provided into the hole 7H formed on the upper surface of the die 7 detachably and changeably.

According to the above structure, in the case where the punch head 17 of the punch 3 is struck by the striker ST mistakably without placing the workpiece W on the die 7, the cutting and protruding blade provided to the lower portion of the punch body does not directly cut into the hard die 7, and the cutting and protruding blade can be protected.

INDUSTRIAL APPLICABILITY

As understanding from the above description, in the invention according to a first claim, since the elastic member is provided between the up/down slider and the punch driver and since the inclined surface of the up/down slider comes into surface-contact with the inclined surface of the punch body which is provided with the cutting and protruding blade at the lower end of the punch body, even in the case where the mounting position of the punch head with respect to the punch driver is not accurate, namely, is too high, this problem is solved by contracting of the elastic member.

In addition, since the elastic member is compressed gradually and restitution becomes stronger gradually, thereby increasing the pressure of the contact between each of the surface-contacting inclined surfaces of the punch body and up/down slider. Therefore, since the component of the force in the horizontal direction which acts to push the punch body in the radial direction, the protrusion on the upper surface of the workpiece can be cut and protruded smoothly.

According to a second claim of the invention, in the invention depending from the first claim, since the workpiece retainer has a guiding hole for guiding the punch body in the radial direction, and since the workpiece retainer has a sliding-contact surface which slides and contacts with a sliding-contact surface formed on the lower portion of the punch body so as to limit a protruding amount of the punch body to the downward direction, the punch body is accurately moved in the radial direction and the cutting and protruding blade appropriately cuts into the workpiece.

According to a third claim of the invention, in the invention depending from the first or second claim, since the lower surface of the up/down slider is provided with a plurality of inclined surfaces having different inclined directions, and since the inclined surfaces slide-contact respectively with other inclined surfaces which are provided on a plurality of upper surfaces of a plurality of punch bodies so that the plurality of punch bodies come close to and separate from each other, a plurality of protrusions are simultaneously produced, thereby enabling to form a constant distance between the vertical surfaces of the plurality of protrusions at any process.

According to a fourth claim of the invention, in the invention depending from the first, second or third claim, since the punch tip which has the cutting and protruding blade is provided at a lower portion of the punch body detachably and changeably, when the cutting and protruding blade is abraded, the cutting and protruding blade is easily detached and mounted to be changed.

According to a fifth claim of the invention, in the invention depending from the fourth claim, since the punch tip has a polygon shape such that the cutting and protruding blades are provided on plural portions of the punch tip, it can easily response to the abrasion of the cutting and protruding blade.

According to a sixth claim of the invention, in the invention depending from the first claim, since the die is provided with a protecting member on an upper surface of the die, and since the material of the protecting member is softer than a material of the die, even the cutting and protruding blade of the punch is accidentally touched against the upper surface of the die, the cutting and protruding blade can be protected.

What is claimed is:

1. A protrusion forming tool device, comprising: a protrusion forming tool for cutting and protruding a portion of a surface of a workpiece so as to form a protrusion by means of cooperation of a punch and a die, wherein the punch includes:

a cylindrical punch guide which is supported to a punch holder in a punch press movably up and down;

a punch driver provided to an upper portion of the punch guide, wherein the punch driver having a punch head at its upper end is movable up and down and is pushed upwardly;

an up/down slider, wherein an inclined surface is provided on a lower surface of the up/down slider and wherein the up/down slider is provided in a position below the punch driver in the punch guide movably up and down;

an elastic member, wherein the elastic member is provided between the up/down slider and the punch driver;

a workpiece retainer, wherein the workpiece retainer is provided at a lower portion of the punch guide; and a punch body, wherein the punch body is provided in a position below the up/down slider in the punch guide so as to be movable up and down and movable in a radial direction of the punch guide and wherein a lower portion of the punch body can be protruded to a downward direction from the workpiece retainer, wherein the punch body is provided with a cutting and protruding blade at a lower end of the punch body for cutting and protruding the protrusion on the surface of the workpiece; and wherein the punch body is provided with an inclined surface on an upper surface of the punch body, and the inclined surface comes into surface-contact with the inclined surface formed on the lower surface of the up/down slider.

2. A protrusion forming tool device according to claim 1, wherein, the workpiece retainer has a guiding hole for guiding the punch body in the radial direction, and the workpiece retainer has a sliding-contact surface which slides and contacts with a sliding-contact surface formed on the lower portion of the punch body so as to limit a protruding amount of the punch body to the downward direction.

3. A protrusion forming tool device according to claim 1, wherein, the lower surface of the up/down slider is provided with a plurality of inclined surfaces having different inclined directions; and wherein the inclined surfaces slide-contact respectively with other inclined surfaces which are provided on a plurality of upper surfaces of a plurality of punch bodies so that the plurality of punch bodies come close to and separate from each other.

4. A protrusion forming tool device according to claim 1, wherein, a punch tip which has the cutting and protruding blade is provided at a lower portion of the punch body detachably and changeably.

5. A protrusion forming tool device according to claim 4, wherein, the punch tip has a polygon shape such that cutting and protruding blades are provided on plural portions of the punch tip.

6. A protrusion forming tool device according to claim 1, wherein, the die is provided with a protecting member on an upper surface of the die; and wherein the material of the protecting member is softer than a material of the die.

7. A protrusion forming tool device according to claim 2, wherein, the lower surface of the up/down slider is provided with a plurality of inclined surfaces having different inclined directions; and wherein the inclined surfaces slide-contact respectively with other inclined surfaces which are provided on a plurality of upper surfaces of a plurality of punch bodies so that the plurality of punch bodies come close to and separate from each other.

8. A protrusion forming tool device according to claim 2, wherein, a punch tip which has the cutting and protruding blade is provided at a lower portion of the punch body detachably and changeably.

9. A protrusion forming tool device according to claim 3, wherein, a punch tip which has the cutting and protruding blade is provided at a lower portion of the punch body detachably and changeably.

* * * * *